US011230804B2

(12) United States Patent
Lee et al.

(10) Patent No.: US 11,230,804 B2
(45) Date of Patent: Jan. 25, 2022

(54) METHOD FOR CONTROLLING WASHING MACHINE

(71) Applicant: LG ELECTRONICS INC., Seoul (KR)

(72) Inventors: Sunho Lee, Seoul (KR); Youngjong Kim, Seoul (KR); Hyungkwan Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 48 days.

(21) Appl. No.: 16/340,013

(22) PCT Filed: Oct. 5, 2017

(86) PCT No.: PCT/KR2017/011104
§ 371 (c)(1),
(2) Date: Apr. 5, 2019

(87) PCT Pub. No.: WO2018/066971
PCT Pub. Date: Apr. 12, 2018

(65) Prior Publication Data

US 2019/0226136 A1 Jul. 25, 2019

(30) Foreign Application Priority Data

Oct. 5, 2016 (KR) ..... 10-2016-0128551

(51) Int. Cl.
*D06F 39/02* (2006.01)
*D06F 39/08* (2006.01)
(Continued)

(52) U.S. Cl.
CPC ..... *D06F 39/02* (2013.01); *D06F 33/34* (2020.02); *D06F 35/006* (2013.01); *D06F 37/40* (2013.01);
(Continued)

(58) Field of Classification Search
CPC .. D06F 33/00; D06F 33/30–76; D06F 35/005; D06F 35/006
See application file for complete search history.

(56) References Cited

U.S. PATENT DOCUMENTS 5,199,127 A * 4/1993 Van Newenhizen ..... D06F 35/006 8/158
7,376,997 B2 5/2008 Kim et al.
(Continued)

FOREIGN PATENT DOCUMENTS

CN 1109120 A 9/1995
CN 1721609 A 1/2006
(Continued)

*Primary Examiner* — Michael E Barr
*Assistant Examiner* — Omair Chaudhri
(74) *Attorney, Agent, or Firm* — Dentons US LLP

(57) ABSTRACT

A method of controlling a washing machine includes the steps of: processing the laundry by using the water supplied together with detergent; draining the water, rotating the inner tub at a high speed, and operating the pump to drain the water discharged from the laundry; rotating the inner tub at a first speed and supplying the water into the inner tub via the dispenser; stopping the supply of water through the dispenser, rotating the inner tub at a second speed, and supplying the water into the inner tub through the spray nozzle; stopping the supply of water through the spray nozzle and alternately rotating the pulsator at a third speed in both directions; stopping rotation of the pulsator, rotating the inner tub at the second speed, and supplying the water into the inner tub through the spray nozzle; operating the pump to drain the outer tub; and rotating the inner tub at a high speed, and operating the pump to drain the water discharged from the laundry.

11 Claims, 9 Drawing Sheets

(51) Int. Cl.

| | |
|---|---|
| ***D06F 37/40*** | (2006.01) |
| ***D06F 33/34*** | (2020.01) |
| ***D06F 35/00*** | (2006.01) |
| ***D06F 103/18*** | (2020.01) |
| ***D06F 105/02*** | (2020.01) |
| ***D06F 105/48*** | (2020.01) |
| *D06F 103/04* | (2020.01) |

(52) U.S. Cl.
CPC ..... *D06F 39/088* (2013.01); *D06F 2103/04* (2020.02); *D06F 2103/18* (2020.02); *D06F 2105/02* (2020.02); *D06F 2105/48* (2020.02)

(56) References Cited

U.S. PATENT DOCUMENTS

| | | | | |
|---|---|---|---|---|
| 8,719,986 | B2 | 5/2014 | Kim et al. | |
| 9,777,423 | B2 * | 10/2017 | Stabon | D06F 29/02 |
| 2004/0045097 | A1 * | 3/2004 | Kim | D06F 35/006 8/159 |
| 2008/0201868 | A1 * | 8/2008 | Bang | D06F 35/006 8/159 |
| 2010/0236001 | A1 * | 9/2010 | Lee | D06F 33/38 8/159 |
| 2015/0252510 | A1 * | 9/2015 | Heo | D06F 33/48 8/137 |

FOREIGN PATENT DOCUMENTS

| | | | | |
|---|---|---|---|---|
| CN | 1908289 | A | 2/2007 | |
| CN | 1948596 | A | 4/2007 | |
| CN | 102102284 | A | 6/2011 | |
| CN | 102251378 | A | 11/2011 | |
| EP | 2602373 | A1 * | 6/2013 | D06F 35/006 |
| KR | 1020000043409 | A | 7/2000 | |
| KR | 10-2002-0069854 | A | 9/2002 | |
| KR | 1020030004707 | A | 1/2003 | |
| KR | 100841833 | B1 * | 6/2008 | |
| KR | 20140145326 | A * | 12/2014 | |
| KR | 1020140145326 | A | 12/2014 | |

* cited by examiner

METHOD FOR CONTROLLING WASHING MACHINE

This application is a National Stage Application of International Application No. PCT/KR2017/011104, filed on Oct. 5, 2017, which claims the benefit of Korean Patent Application No. 10-2016-0128551, filed on Oct. 5, 2016, all of which are hereby incorporated by reference in their entirety for all purposes as if fully set forth herein.

TECHNICAL FIELD

The present invention relates to a control method of washing machine.

BACKGROUND ART

Generally, a washing machine is an apparatus that processes laundry through various operations such as washing, dewatering and/or drying. The washing machine includes an outer tub containing water and an inner tub rotatably provided in the outer tub, and the inner tub is provided with a plurality of through holes through which water passes.

When a user selects a desired course by using a control panel in a state in which laundry (hereinafter, also referred to as "cloth") such as clothes or bedding is put in the inner tub, a preset algorithm corresponding to the selected course is executed, thereby performing washing, rinsing, dewatering, and the like.

An ordinary washing machine processes a laundry by sequentially performing a series of operations of a washing operation, a rinse operation, and a dewatering operation. Such a washing machine is provided with a dispenser for selectively supplying a laundry detergent, a rinsing agent, a bleach, etc. along with water depending on a progressing operation.

The water supply in the course of operation of the washing machine may be classified into a water supply (hereinafter referred to as "washing water supply") for use in washing and a water supply (hereinafter referred to as "rinsing water supply") for use in rinsing. During the washing water supply, the detergent is supplied together with the water through the dispenser. During the rinsing water supply, the rinsing agent is supplied through the dispenser (when the rinsing agent is not applied, only the raw water supplied through an external water source (e.g., a faucet) is supplied).

Meanwhile, the washing operation is a step of removing the contamination of the laundry by using a detergent for washing. After the water is supplied (washing water supply) together with the detergent, a pulsator and/or the inner tub is rotated according to a preset pattern. The washing operation is completed by draining the water used for washing, and then a rinsing operation is performed.

In the rinsing operation, the rinsing water is supplied into the inner tub, and the pulsator is rotated in a preset pattern, so that the laundry detergent adhered to the laundry is diluted with water. Conventionally, in order to reduce the total time required for the rinsing operation, the pulsator is rotated while performing the water supply. However, in this case, when the water level rises due to the water supply, the laundry is easily separated from the pulsator by buoyancy. Therefore, there is a problem that the rinsing performance is deteriorated. In addition, in order to obtain a desired rinsing performance, there is a problem that the pulsator must be driven for a longer period of time, thereby increasing power consumption and overall washing time.

DISCLOSURE

Technical Problem

A problem to be solved by the present invention is to more reliably remove the detergent adhered to the laundry during the washing operation, and to reduce the total time required for such a rinsing. In particular, it is an object of the present invention to provide a control method of washing machine in which the rotation of an inner tub, the water spray by a spray nozzle, and the rotation of the pulsator are configured in an appropriate manner.

In addition, it is an object of the present invention to improve the rinsing performance by forming a water stream (hereinafter referred to as "centrifugal circulation water stream") poured into the inner tub from the outer tub through the rotation of the inner tub to remove the detergent adhered to the laundry in the washing operation and, at the same time, by applying water to the laundry through the spray nozzle through a comprehensive factor such as the physical force due to the centrifugal circulation water stream, the removal of the detergent in the process where the water stream passes through the laundry adhered to the inner side of the inner tub, and the rinsing by the water stream directly applied to the laundry through the spray nozzle.

Further, it is an object of the present invention to provide a control method of washing machine for improving the rinsing performance and evenly dispersing the laundry, by repeating a step of spraying water through the spray nozzle during the formation of the centrifugal circulation water stream and a step of the stirring rotation (or alternately rotating in both directions) of the pulsator.

Technical Solution

The present invention relates to a control method of a washing machine comprising an outer tub containing water; an inner tub which accommodates laundry and is rotatably installed in the outer tub; a pulsator rotatably provided in a lower portion of the inner tub; a dispenser which supplies rinsing agent into the inner tub; a spray nozzle for spraying water into the inner tub; and a pump for draining the water in the outer tub.

The control method of the washing machine drains the water used for washing, after processing the laundry by using the water supplied with the detergent. Thereafter, the inner tub is rotated at a high speed, and the pump is operated to drain the water discharged from the laundry.

Thereafter, the inner tub is rotated at a first speed, and water is supplied into the inner tub via the dispenser. At this time, the rinsing agent contained in the dispenser may be supplied together with the water.

Water supply through the dispenser is stopped, the inner tub is rotated at a second speed, and water is supplied into the inner tub through the spray nozzle. The second speed may be set within a range in which the washing water between the outer tub and the inner tub can be raised higher than the upper end of the inner tub when the inner tub is rotated at the second speed.

The second speed may be 120 to 150 rpm. The second speed may be set according the cloth amount.

A step of stopping the water supply through the spray nozzle and alternately rotating the pulsator at a third speed in both directions may be performed.

The step of rotating the inner tub at the second speed and supplying the water through the spray nozzle and the step of rotating the pulsator in both directions at the third speed may be repeated a preset number of times. The third speed may be set according the cloth amount. The third speed may be 70 to 90 rpm.

Thereafter, a step of stopping the rotation of the pulsator, rotating the inner tub at the second speed, and supplying the water into the inner tub through the spray nozzle may be performed.

Thereafter, a step of operating the pump to drain the outer tub, rotating the inner tub at a high speed, and operating the pump to drain the water discharged from the laundry.

Advantageous Effects

The control method of washing machine of the present invention has the effect of more reliably removing the detergent adhered to the laundry during the washing operation and reducing the total time required for such rinsing.

In addition, it has the effect of improving the rinsing performance, by the interaction of the permeation effect of the water stream passing through the laundry adhered to the inner surface of the inner tub, and the rinsing power due to the water stream directly applied to the laundry through the spray nozzle, along with the physical force due to centrifugal circulation water stream.

In addition, it has the effect of improving the rinsing performance and evenly dispersing the laundry, by repeating the step of spraying water through the spray nozzle during the formation of the centrifugal circulation water stream and the step of the stirring rotation (or alternately rotating in both directions) of the pulsator.

MODE FOR INVENTION

Figure 1:
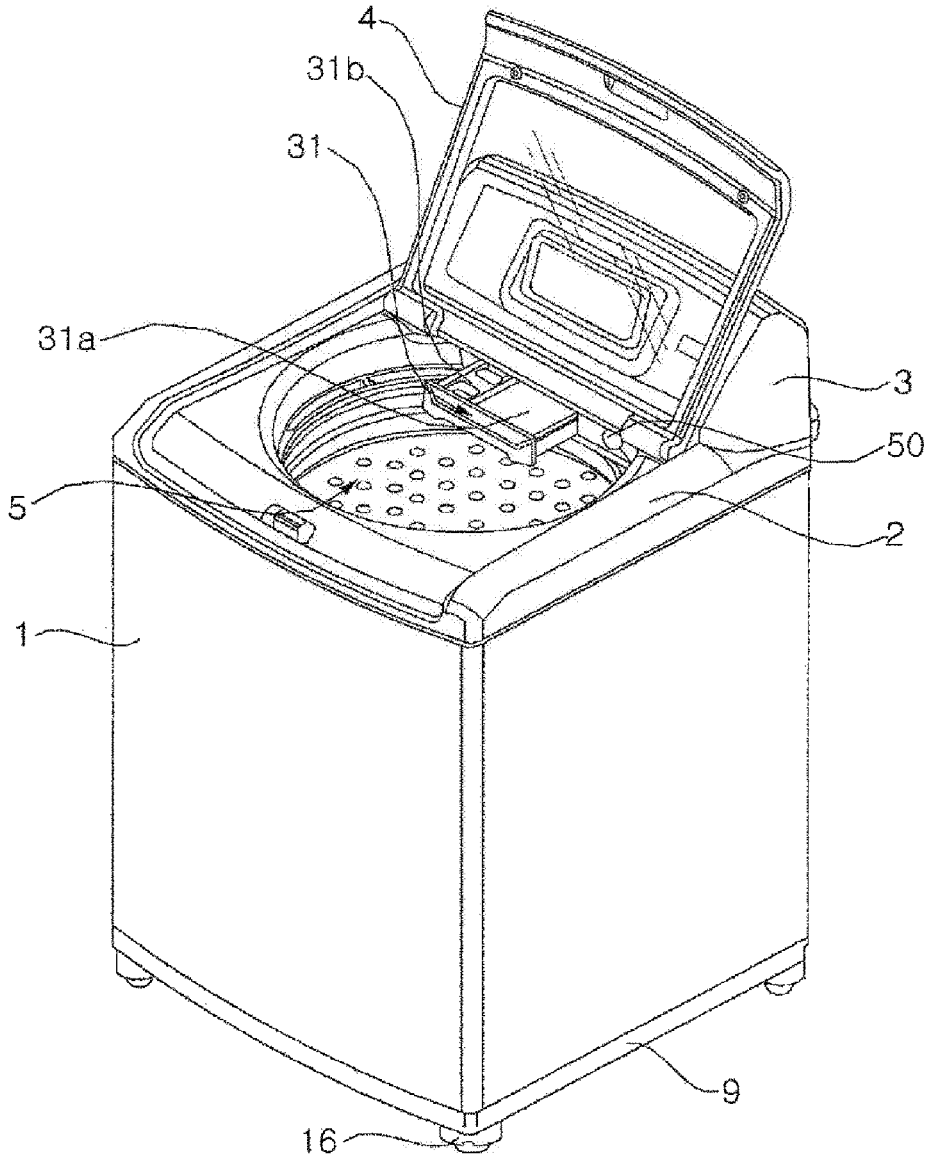
FIG. 1 is a perspective view of a washing machine according to an embodiment of the present invention.

Hereinafter, preferred embodiments of the present invention will be described with reference to the accompanying drawings. In describing the present embodiment, the same designations and the same reference numerals are used for the same components, and further description thereof will be omitted.

Figure 2:
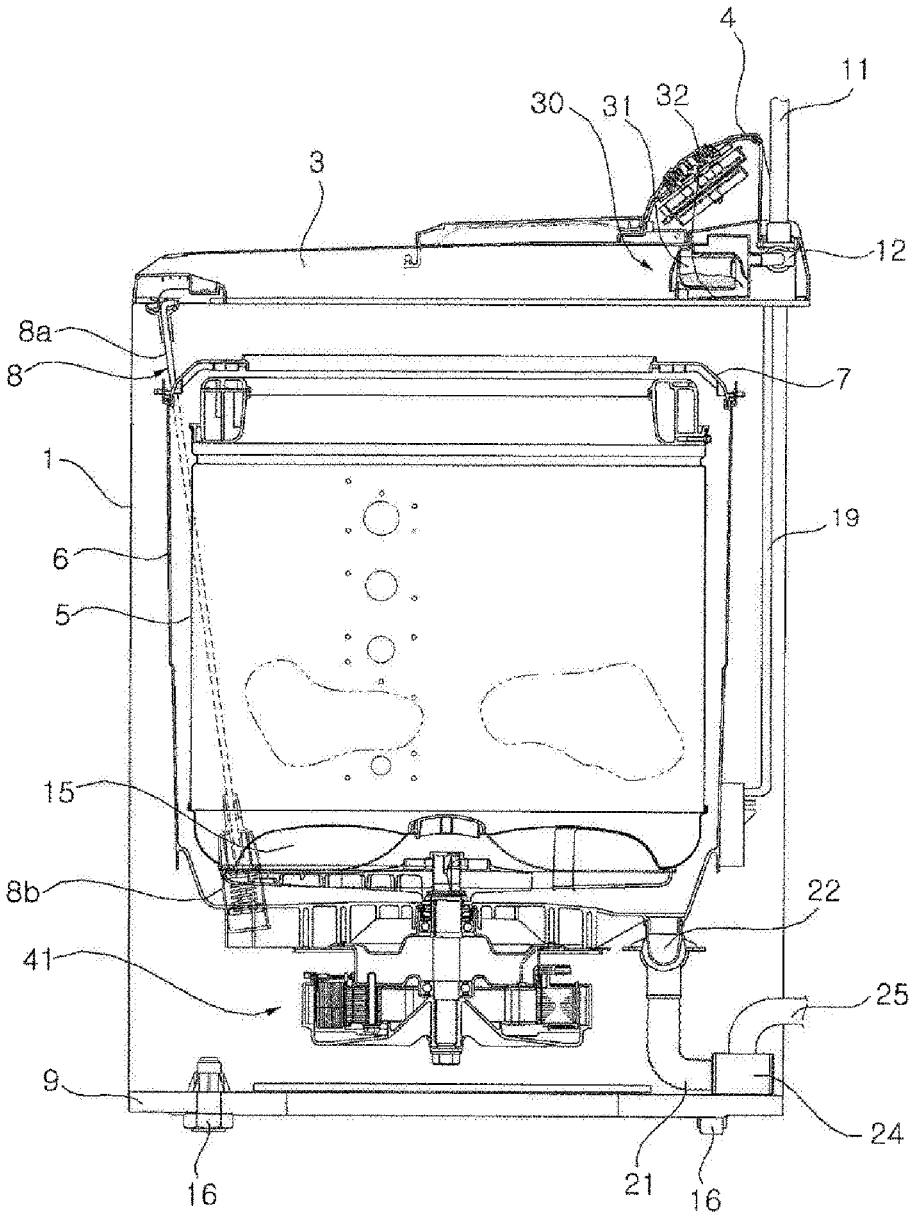
FIG. 2 is a side sectional view of the washing machine shown in FIG. 1.
Figure 3:
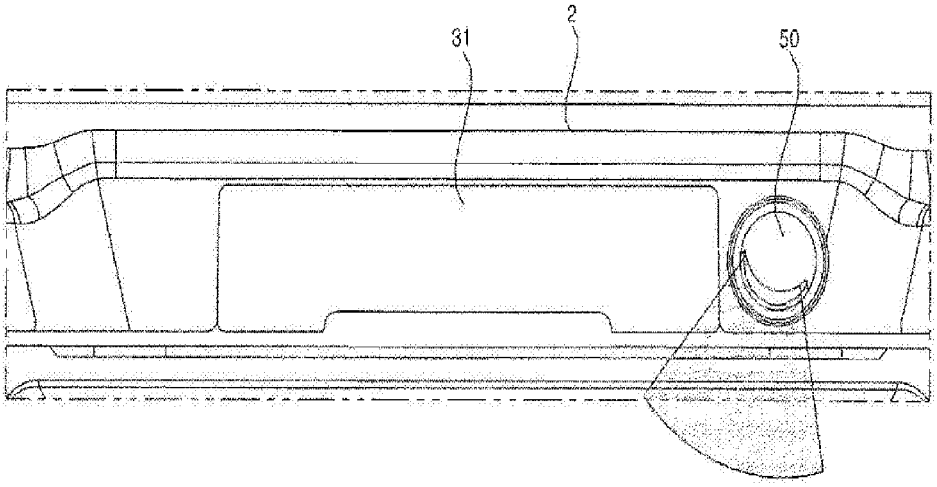
FIG. 3 is a partial view of a top cover shown in FIG. 1.
Figure 4:
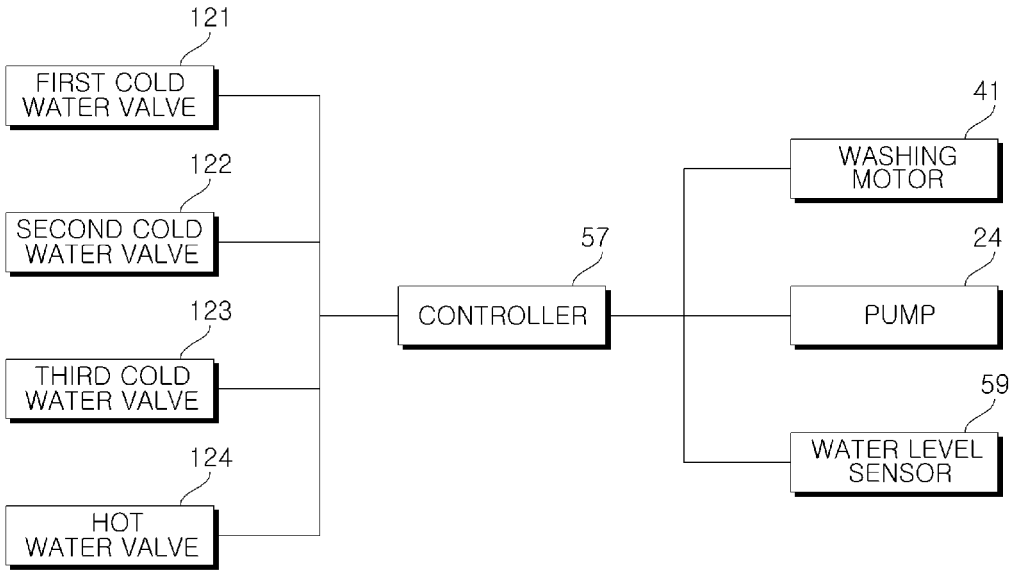
FIG. 4 is a block diagram showing a control relationship between main parts of a washing machine according to an embodiment of the present invention.

FIG. 1 is a perspective view of a washing machine according to an embodiment of the present invention. FIG. 2 is a side sectional view of the washing machine shown in FIG. 1. FIG. 3 is a partial view of a top cover shown in FIG. 1. FIG. 4 is a block diagram showing a control relationship between main parts of a washing machine according to an embodiment of the present invention.

Referring to FIGS. 1 to 4, a washing machine according to an embodiment of the present invention may include a cabinet 1, a top cover 2, a lid 4, a base 9, and a control panel 3.

The cabinet 1 may be supported by the base 9, and may include a front surface, both side surfaces, and a rear surface which are installed along the outer edge of the base 9 so as to form a space for accommodating the outer tub 6 inwardly.

The base 9 is formed in a flat shape corresponding to the floor where the washing machine is provided, and may be supported by four supporting legs 16 provided near four corners of the cabinet 1.

The top cover 2 may be coupled to the upper end of the cabinet 1. The top cover 2 may be provided with a loading port for loading and unloading the laundry (or "cloth"), and the lead 4 for opening and closing the loading port may be rotatably coupled to the top cover 2.

In the cabinet 1, an outer tub 6 for storing water may be disposed. The outer tub 6 may be provided in a form of hanging in the cabinet 1 by a hanger 8. The hanger 8 may include a support rod 8*a* whose upper end is pivotably coupled with the top cover 2, and a suspension 8*b* which is installed in the support rod 8*a* to buffer the vibration of the outer tub 6. Such a suspension 8*b* may be configured in various forms. For example, the suspension 8*b* may include an outer tub support member which supports the outer tub 5 and is moved along the support rod 8*a* as the outer tub 6 vibrates, and a spring which is fixed to the lower end of the support rod 8*a* and resiliently supports the outer tub support member. The hanger 8 may be provided at four corners of the cabinet 1, respectively.

The upper side of the outer tub 6 may be open, and an outer tub cover 7 may be provided in the opened upper side. The outer tub cover 7 may be formed in a ring shape having an open central portion for the loading/unloading of laundry.

In the outer tub 6, an inner tub 5 that accommodates the laundry and is rotated about a vertical axis may be disposed. The inner tub 5 may be formed with a plurality of holes through which water can pass, and water can be exchanged between the inner tub 5 and the outer tub 6 through the hole.

A drainage bellows 21 for draining water from the outer tub 6 and a drainage valve 22 for interrupting the drainage bellows 21 may be provided. The drainage bellows 21 is connected to a pump 24, and water may be supplied to the pump 24 through the drainage bellows 21 when the drainage valve 22 is opened. Hereinafter, although not specifically described, it should be understood that the pump 24 is operated in a state in which the drainage bellows 21 is open.

A pulsator 15 may be rotatably provided in the inner lower portion of the inner tub 5. The pulsator 15 may include a plurality of upwardly projected radial ribs. When pulsator 15 is rotated, water stream may be formed by the ribs.

A washing motor 41 may be disposed in the cabinet 1 to provide power for rotating the inner tub 5 and the pulsator 15. The washing motor 41 may be provided below the outer tub 6 and may be provided in the form of hanging in the cabinet 1 together with the outer tub 6. A rotary shaft of the washing motor 41 is always coupled with the pulsator 15 and may be coupled with or discoupled from the inner tub 5 depending on the switching operation of a clutch (not shown). Therefore, when the washing motor 41 is operated in a state where the rotary shaft is coupled with the inner tub 5, the pulsator 15 and the inner tub 5 are integrally rotated.

When the rotary shaft is separated from the inner tub 5, only the pulsator 15 is rotated in the state where the inner tub 5 is stopped.

A transmission (not shown) that shifts the speed (or the number of revolutions) of the washing motor 41 and transfers the shifted speed to the pulsator 15 may be further provided. In a state in which the inner tub 5 is separated from the rotary shaft of the washing motor 41 by the clutch (i.e., in a state in which only the pulsator 15 is rotated), the pulsator 15 may be rotated at a speed reduced by the transmission at a preset deceleration ratio n. When the rotation speed of the washing motor 41 is n, the pulsator 15 is rotated at a speed of 1, and "n" at this time is defined as a deceleration ratio. Hereinafter, the deceleration ratio n is 3, but it is not limited thereto.

A brushless direct current motor (BLDC motor), which is capable of controlling a speed and widely applicable to a conventional washing machine, is suitable for the washing motor 41, but is not necessarily limited thereto. As a method of controlling the speed of the BLDC motor, various methods including a vector control method of the input current of motor by feedback of the output of motor by using a proportional-integral controller (PI controller), a proportional-integral-derivative controller (PID controller), and the like are already well known. Thus, the speed control of the washing motor 41 may be achieved by the type of the motor and a corresponding known method. Therefore, a detailed description thereof will be omitted.

The top cover 2 may be provided with a dispenser 30 for supplying an additive acting on laundry to the inner tub 5 together with water. The additive supplied by the dispenser 30 may be a detergent and a fabric softener (or a rinsing agent).

The pump 24 is connected to the drainage bellows 21 for discharging water from the outer tub 6. The water pumped by the pump 24 is discharged to the outside through the drainage hose 25.

The dispenser 30 may include a dispenser housing 32 disposed inside the top cover 2 and a drawer 31 which contains the additive and is drawably accommodated in the dispenser housing 32. The top cover 2 may be provided with a draw opening for allowing the drawer 31 to pass therethrough, and the dispenser housing 32 may have an opening formed on one surface thereof facing the draw opening in correspondence with the draw opening.

The drawer 31 may be divided into a detergent accommodating portion 31*a* for accommodating the detergent for washing and a rinsing agent accommodating portion 31*b* for accommodating the rinsing agent. The detergent accommodating portion 31*a* and the rinsing agent accommodating portion 31*b* are divided into structures such as rib, partition, and the like. Thus, when water is supplied to the detergent accommodating portion 31*a*, only detergent is supplied into the inner tub 5 together with the water. On the other hand, when the water is supplied to the rinsing agent accommodating portion 31*b*, only the rinsing agent is supplied into the inner tub 5 together with water.

The washing machine may include a spray nozzle 50 for spraying water into the inner tub 5. The spray nozzle 50 may be installed in the top cover 2, and is preferably disposed beside the drawer 31.

The washing machine may include at least one water supply hose 11 for guiding water supplied from an external water source such as a faucet. The at least one water supply hose 11 may include a cold water hose (not shown) for receiving cold water from the external water source and a hot water hose (not shown) for receiving hot water.

A valve assembly 12 for interrupting the water supplied through the at least one water supply hose 11 may be provided. The valve assembly 12 may include at least one water supply valve 121, 122, 123, 124.

The hot water supplied through the hot water hose may be supplied into the inner tub 5 via the dispenser 30. At this time, the hot water passes through the detergent accommodating portion 31*a* of the drawer 31. A hot water flow path (not shown) for guiding the water supplied through the hot water hose to the detergent accommodating portion 31*a* may be provided, and the valve assembly 12 may include a hot water valve 124 for interrupting the hot water flow path under the control of a controller 57.

The cold water supplied through the cold water hose may be selectively supplied to the dispenser 30 or the spray nozzle 50. At this time, the cold water supplied to the dispenser 30 may be supplied again into the inner tub 5, after selectively passing the detergent accommodating portion 31*a* or the rinsing agent accommodating portion 31*b* of the drawer 31.

A first cold water flow path (not shown) for guiding the water supplied through the cold water hose to the detergent accommodating portion 31*a*, and a second cold water flow path (not shown) for guiding the water to the rinsing agent accommodating portion 31*b* may be provided. The valve assembly 12 may include a first cold water valve 121 for interrupting the first cold water flow path and a second cold water valve 122 for interrupting the second cold water flow path. The first cold water valve 121 and the second cold water valve 122 may be operated under the control of the controller 57.

A third cold water flow path (not shown) for guiding the cold water supplied through the cold water hose to the spray nozzle 50 may be provided. The valve assembly 12 may include a third cold water valve 123 for interrupting the third cold water flow path under the control of the controller 57.

The control panel 3 may include an input means such as a key, a button, a touch panel, and the like capable of setting, selecting, and adjusting various operation modes provided by the washing machine, and a display panel such as a lamp, an LCD panel, an LED panel, and the like for displaying various information such as a operating state of the washing machine, a response, a warning, a notification, and the like according to the selection of the operation mode may be provided.

A water level sensor 59 detects the water level in the outer tub 6. A communicating pipe 19 elongated vertically is communicated with the outer tub 6. The water level sensor 59 detects the air pressure in the communicating pipe 19 which varies according to the water level in the outer tub 6 and outputs a frequency signal. The controller 57 may determine the water level according to the frequency signal. However, the present invention is not limited thereto, and the water level sensor 59 may be implemented in other well-known methods.

Figure 5:
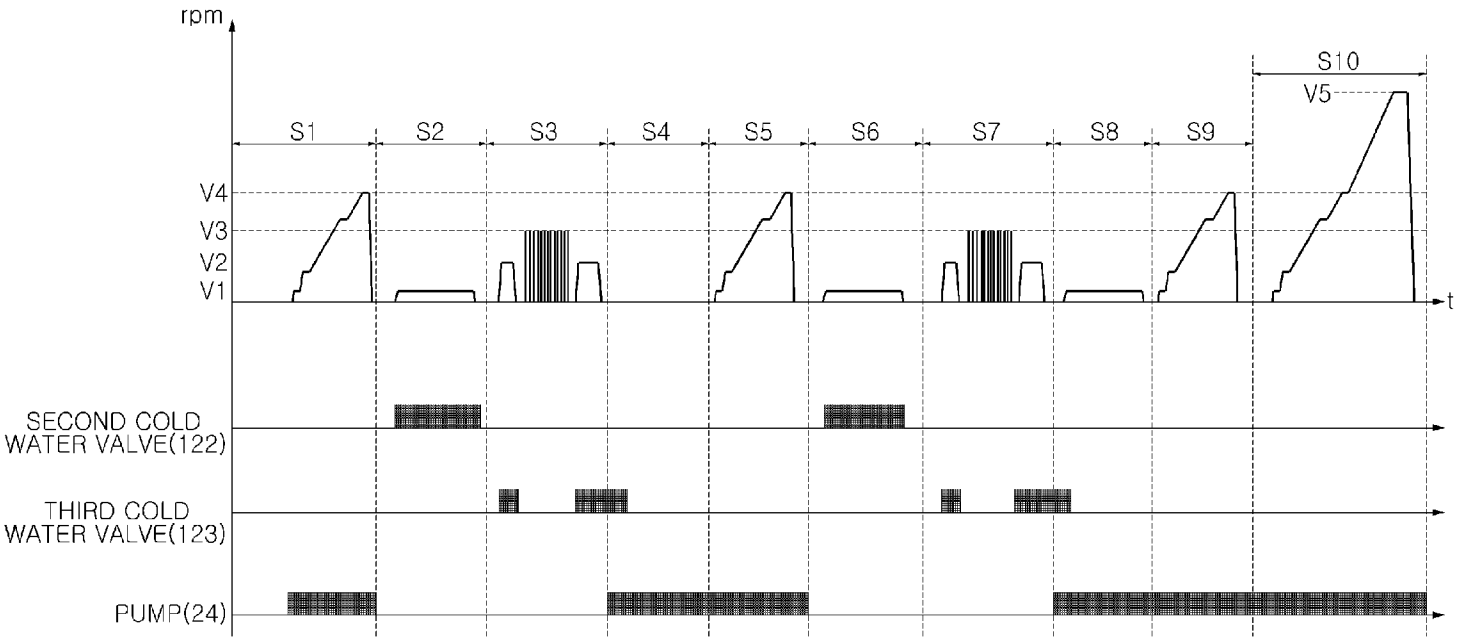
FIG. 5 is a graph showing the operation control of the main parts according to a control method of a washing machine of an embodiment of the present invention.
Figure 6:
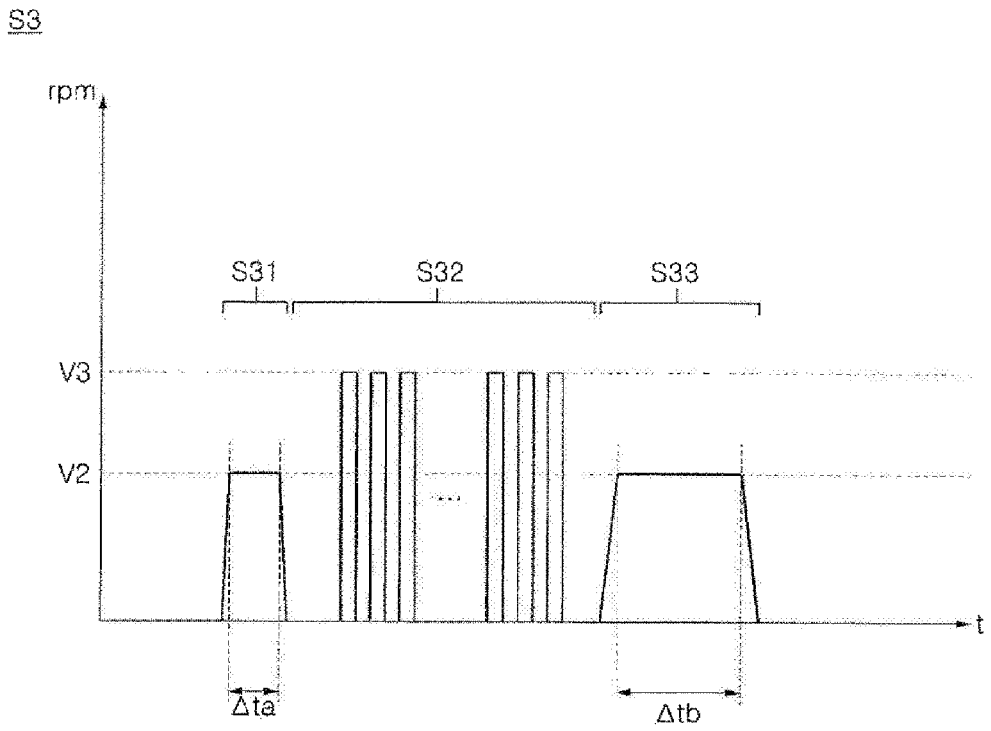
FIG. 6 shows step S3 in FIG. 5 in more detail.
Figure 7:
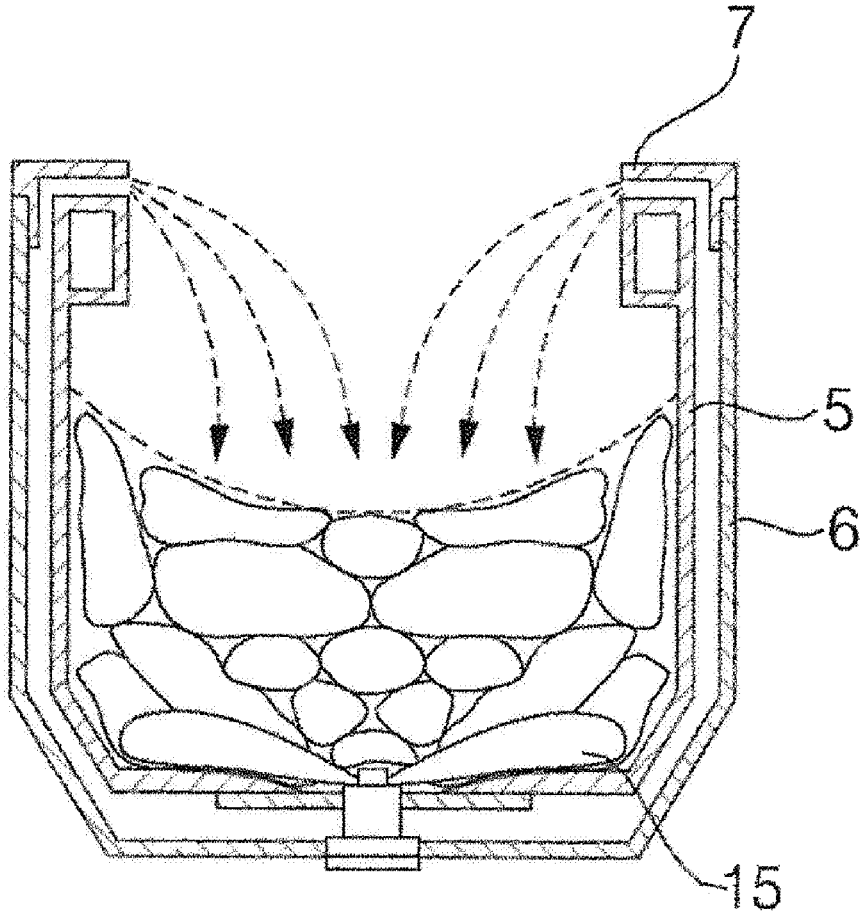
FIG. 7 schematically shows a centrifugal circulation water stream.
Figure 8:
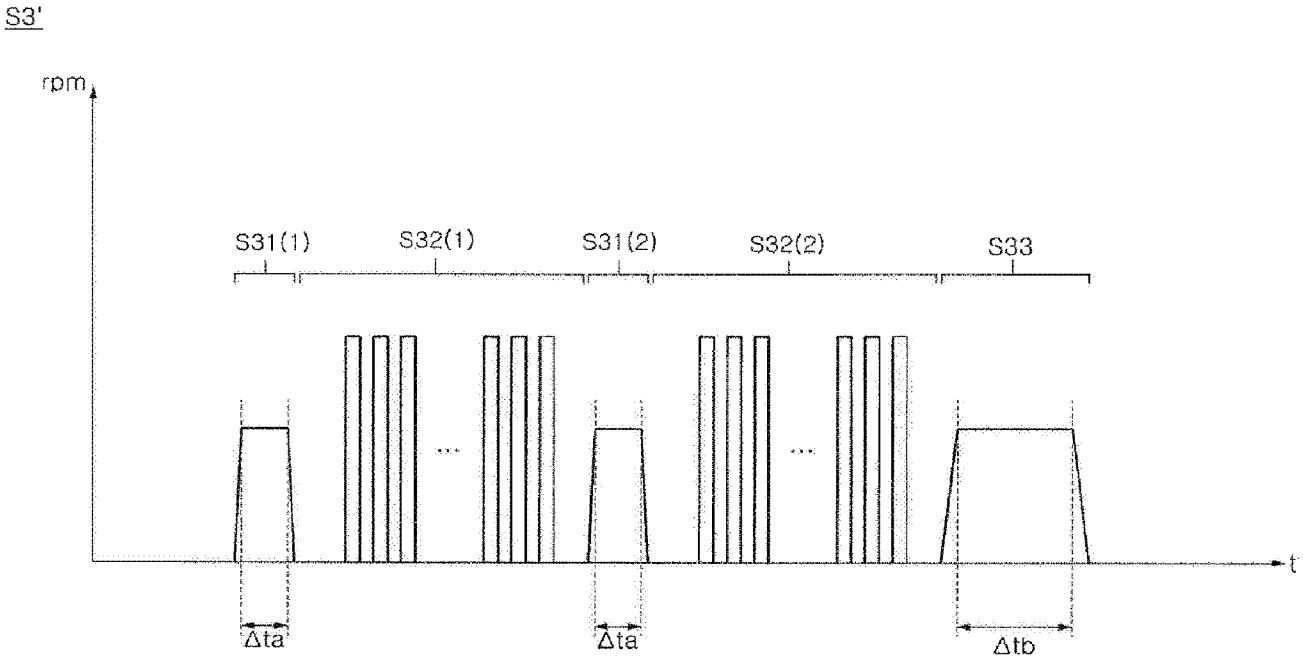
FIG. 8 is another embodiment of the step S3 of FIG. 5.

FIG. 5 is a graph showing the operation control of the main parts according to a control method of a washing machine of an embodiment of the present invention. FIG. 6 shows step S3 in FIG. 5 in more detail. FIG. 7 schematically shows a centrifugal circulation water stream. FIG. 8 is another embodiment (S3') of the step S3 of FIG. 5.

Hereinafter, it is exemplified that the inner tub 5 is rotated at the same speed as the washing motor 41 (at this time, the pulsator 15 rotates at the same speed as the inner tub 5), and the speed ratio (or deceleration ratio) the washing pump 41 and the pulsator 15 is 3:1. The vertical axis (rpm axis) of the graph shown in the drawing indicates the rotation speed of the washing motor 41. In addition, in the graph, the sections in which the second cold water valve 122, the third cold water valve 123, and the pump 24 are operated are indicated as a block.

Referring to FIGS. 5 to 7, the control method of washing machine according to an embodiment of the present invention may include a step (hereinafter referred to as a "washing step") of processing laundry with water supplied with the detergent, and steps S1 to S10 performed later.

The washing step is a step of supplying water together with the detergent through the dispenser 30 and rotating the pulsator 15 and/or the inner tub 5 according to a preset algorithm to remove the contamination on the laundry. The washing step generally constitutes a washing operation.

In step S1, the water used in the washing step is drained, and the inner tub 5 is rotated at a high speed to perform the dewatering of the laundry. Specifically, when the pump 24 is first operated to discharge the water in the outer tub 6 and the water level detected by the water level sensor 59 reaches a preset water level (hereinafter referred to as "dewatering water level"), the controller 57 controls the washing motor 41 to rotate the inner tub 5 at high speed. It is preferable that the dewatering water level is an empty water level (the state in which all the water in the outer tub 6 is discharged). However, in consideration of the minimum water level that the water level sensor 59 can detect, a small amount of water may remain in the outer tub 6.

Even after the water level in the outer tub 6 reaches the dewatering water level, the drainage may be performed even when the inner tub 5 is accelerated as the pump 24 continues to operate. However, depending on an embodiment, the operation of the pump 24 may be stopped when the water level reaches the dewatering water level, and then, the pump 24 may be operated again when the time of rotating the inner tub 5 reaches a preset time, or when the water level sensor 59 detects that the water level in the outer tub 6 reaches a preset water level due to the dewatered water from the laundry, In step S1, the inner tub 5 is accelerated up to a preset first target dewatering speed V4. At this time, the speed of the inner tub 5 may be increased up to the first target dewatering speed V4. The first target dewatering speed V4 is set to approximately 400 rpm, but is not necessarily limited thereto.

Step S1 is completed while the rotation of the inner tub 5 is stopped, and then step S2 may be performed. In step S2, the inner tub 5 is rotated at a first speed V1. In this process, water may be supplied into the inner tub 5 via the dispenser 30.

The first speed V1 is set within a range in which at least some cloth in the inner tub 5 can be displaced. As the rotation speed of the inner tub 5 increases, the centrifugal force increases so that cloth becomes attached to the inner surface of the inner tub 5. At this time, since the cloth is rotated integrally with the inner tub 5, the position with respect to the inner tub 5 is fixed. The magnitude of the centrifugal force applied to the cloth varies depending not only on the rotation speed of the inner tub 5 but also on the position of the cloth in the inner tub 5. For example, assuming that the inner tub 5 is rotated at the same speed in the case of a small amount of cloth loaded into the inner tub 5 and in the case of a large amount of cloth, the full amount of cloth may be adhered to the inner surface of the inner tub 5 in the case of a small amount. However, in the case of a large amount, the displacement of the cloth is limited due to the interference between the cloths. Thus, among the cloths, the cloths close to the rotation center of the inner tub 5 can not receive sufficient centrifugal force, so that it can not be rotated integrally in a state where the position with respect to the inner tub 5 is fixed. Therefore, it is preferable that the rotation speed of the inner tub 5, which permits the displacement of at least some cloths in the inner tub 5, is determined differently depending on the amount of cloth.

In this respect, the control method according to an embodiment of the present invention may include a step (hereinafter, referred to as "cloth amount detecting step") of detecting the amount of laundry (i.e., cloth amount) loaded into the inner tub 5, and the first speed V1 may be set according to the cloth amount detected in the cloth amount detecting step. That is, when the detected cloth amount is large (or when the cloth amount is divided into several sections and the section to which the detected cloth amount belongs is large), the first speed V1 may be set to have a larger value. The first speed V1 may be set between 30 rpm and 120 rpm.

In the embodiment, when the cloth amount is divided into levels 1 to 10, a case where the cloth amount is level 6 is exemplified. At this time, the first speed V1 is set to 30 rpm. In step S2, a rinsing agent may be supplied through the dispenser 30. The controller 57 may open the second cold water valve 122 to supply the cold water to the rinsing agent accommodating portion 31*b* of the drawer 31.

In step S2, the rinsing agent supplied together with the cold water impregnates into the laundry. In particular, since the laundry is moved together with the inner tub 5 while the inner tub 5 rotates, the rinsing agent may impregnate evenly into the laundry.

In step S2, the supply of water through the dispenser 30 may be performed until the water level in the outer tub 6 becomes equal to or higher than a preset centrifugal circulation water level. When the inner tub 5 is rotated at a second speed V2 of step S3 described later in the state where the water level in the outer tub 6 reaches the centrifugal circulation water level, the washing water between the outer tub 6 and the inner tub 5 may be raised higher than the upper end of the inner tub 5 by the centrifugal force caused by the rotation of the inner tub 5. The centrifugal circulation water level may also be determined according to the second speed V2 value in step S3 described later.

The water stream pattern (hereinafter referred to as "centrifugal circulation water stream") at this time is shown in FIG. 7. The water stream raised above the upper end of the inner tub 5 is guided along the outer tub cover 7 and poured into the inner tub 5 again.

A water supply target water level in step S2 may be set to be equal to or higher than the centrifugal circulation water level. The water level may be detected by the water level sensor 59 while the water is being supplied through the dispenser 30. When the water level reaches the water supply target water level, the controller 57 may block the second cold water valve 122.

After the step S2 is completed as the supply of water through the dispenser 30 is stopped and the rotation of the inner tub 5 is stopped, step S3 may be performed.

Step S3 may include a step S31 of rotating the inner tub 5 at the second speed V2 and supplying water into the inner tub 5 through the spray nozzle 50, a step S32 of alternately rotating the pulsator 15 in both directions at a third speed (V3/3) in a state where water supply through the spray nozzle 50 is stopped, and a step S33 of rotating the inner tub 5 at the second speed V2 and supplying the water into the inner tub 5 through the spray nozzle 50, after the rotation of the pulsator 15 is stopped.

In step S31, a centrifugal circulation water stream is formed while the inner tub 5 is rotated at the second speed V2. In this process, the water sprayed through the spray nozzle 50 is applied to the laundry. That is, in step S31, not only the laundry may be rinsed by using the centrifugal circulation water stream generated by the water in the outer tub 6, but also there is an effect that the residual detergent introduced in the washing step is diluted by the water additionally supplied through the spray nozzle 50.

Particularly, in the step S31, in the process that the water stream passes through the laundry attached to the inner surface of the inner tub 5 and is discharged to the outer tub 6, not only the detergent adhered to the fibers can be actively removed, but also the fiber softening action due to rinsing agent is increased. In addition, since the water sprayed through the spray nozzle 50 sometimes directly comes in contact with the laundry, the rinsing performance is further improved.

The second speed V2 may be set according to the cloth amount in the outer tub 6. At this time, when the detected cloth amount is large (or when the cloth amount is divided into several sections and the section to which the detected cloth amount belongs is large), the second speed V2 may be set to have a smaller value. When the cloth amount detected in the cloth amount detecting step is large, since water is supplied to a higher water level in step S2, centrifugal circulation water stream can be formed even if the rotation speed of the inner tub 5 is low. The second speed V2 may be set between 120 and 150 rpm. In the embodiment, when the cloth amount is divided into level 1 to level 10, the second speed V2 is configured to be set to 150 rpm in the case of level 4 or higher, and to be set to 120 rpm in the case of below level 4, but the present invention is not limited thereto.

The controller 57 may control the time for spraying the water through the spray nozzle 50. A timer (not shown) for measuring the time may be provided, and the controller 57 may open the third cold water valve 123 for a preset spray time, based on the time measured by the timer. It is preferable that the inner tub 5 is rotated at the second speed V2 during the time when the third cold water valve 123 is opened.

The spray time may be set according to the cloth amount. When the cloth amount is large (or when the cloth amount is divided into several sections, and the section to which the detected cloth amount belongs is large), the spray time may be set to have a larger value. For example, when the cloth amount is divided into level 1 to level 10, the spray time may be set to 50 seconds for levels 1 to 4, set to 60 seconds for levels 5 to 8, and set to 180 seconds for levels 9 to 10.

After the step S31 is completed as the supply of water through the spray nozzle 50 is stopped and the rotation of the inner tub 5 is stopped, step S32 may be performed.

In step S32, the pulsator 15 is alternately rotated in both directions at the third speed (V3/3). When the step S31 is completed, since the centrifugal force due to the rotation of the inner tub 5 is no longer applied, the laundry adhered to the inner surface of the inner tub 5 is dropped due to its own weight to be gathered on the pulsator 15. By rotating the pulsator 15 in this state, the laundry can be evenly dispersed.

While the pulsator 15 is rotated once in one direction, the pulsator 15 may be rotated approximately 360 degrees. The speed V3 shown in the drawing is the rotation speed of the washing motor 41. In the embodiment, since the deceleration ratio n is 3, the third speed is V3/3.

The third speed may be set according to the cloth amount detected in the cloth amount detecting step. At this time, when the detected cloth amount is large (or when the detected cloth amount is divided into several sections and the section to which the detected cloth amount belongs is large), the third speed may be set to have a larger value. Since the load applied to the pulsator 15 becomes larger as the cloth amount becomes larger, the pulsator 15 is rotated at a higher speed. The third speed may be set to 70 to 90 rpm (i.e., V3 is set to 210 to 270 rpm). In the embodiment, when the cloth amount is divided into level 1 to level 10, the third speed is set to 70 rpm (i.e., V3=210 rpm), if the cloth amount is level 6.

Referring to FIG. 8, step S31 and step S32 may be repeated a preset number of times (S31(1), S32(1), S31(2), S32(2)). In this case, since the step S31(2) and following steps are performed in the state in which the laundry is dispersed evenly in the step S32(1), there is an effect that unbalance (or vibration) is prevented from being generated in the process in which the laundry is rotated integrally with the inner tub 5.

After the step S32 is completed as the rotation of the pulsator 15 is stopped, and step S33 may be performed. In step S33, as in step S31, the inner tub 5 is rotated at the second speed V2, and the water may be supplied into the inner tub 5 through the spray nozzle 50

The time Δtb during which the inner tub 5 is rotated at the second speed V2 in the step S33 may be set longer than the time Δta during which the inner tub 5 is rotated at the second speed V2 in the step S31. The time for spraying through the spray nozzle 50 (i.e., the time during which the third cold water valve 123 is opened) in the step S33 may also be longer than that in the step S31, in correspondence with the longer rotation time of the inner tub 5. The water supply through the spray nozzle 50 in the step S33 may continue after the rotation of the inner tub 5 is stopped, and may be performed while the water is drained in step S4 described later.

Step S4 may be performed after the rotation of the inner tub 5 in step S33 is stopped. In the step S4, the inner tub 5 may be rotated at the first speed V1. The rotation of the inner tub 5 is substantially the same as the step S2, but depending on an embodiment, the inner tub 5 may be rotated at a speed different from that in the step S2. In the present embodiment, the inner tub 5 is rotated at 30 rpm, but it is not necessarily limited thereto.

Drainage may be performed while the inner tub 5 is rotated in step S4. The controller 57 operates the pump 24 to drain water and, obviously, at this time, the drainage valve 22 is open.

The water may be supplied through the spray nozzle 50 even when the step S4 is performed. In the embodiment, the spray through the spray nozzle 50 performed in the step S33 continues until an initial certain section of the step S4. However, the present invention is not limited thereto, and it is obvious that the spray may be stopped after the step S33, and then may be performed again during the step S4. Particularly, in the step S4, since water is sprayed through the spray nozzle 50 during drainage, the washing water applied to the laundry is immediately drained.

The water level is detected by the water level sensor 59 during the step S4. When the detected water level reaches the dewatering water level (preferably, empty water level), the controller 57 stops the washing motor 41 to terminate the step S4. However, the present invention is not limited thereto, and it is also possible to control to stop the rotation of the inner tub 5, after the time during when the pump 24 is operated is sufficiently elapsed until the water level of the outer tub 6 reaches the dewatering water level.

After the step S4 is completed as the rotation of the inner tub 5 is stopped, step S5 may be performed. In the step S5, the inner tub 5 is rotated at a high speed, and the pump 24 is operated to drain the water discharged from the laundry.

In the step S5, the inner tub 5 is accelerated up to a preset first target dewatering speed V4. At this time, the speed of the inner tub 5 may be increased to the first target dewatering speed V4 stepwise. According to an embodiment, the target dewatering speed in the step S5 may be set to a value (e.g., 450 rpm) different from that in the step S1.

Steps S6 to S9 substantially repeat the steps S2 to S5, and a description thereof will be omitted based on the above description.

In step S10, the inner tub 5 is accelerated to a preset second target dewatering speed V5. At this time, the speed of the inner tub 5 may be increased to the second target dewatering speed V5 stepwise. Preferably, the second target dewatering speed V5 is larger than the first target dewatering speed V4 in the step S1 (or step S9), and is set to approximately 700 rpm in the embodiment, but is not necessarily limited thereto.

The pump 24 may be operated so that the water dewatered from the laundry can be drained while the step S10 is performed.

Figure 9:
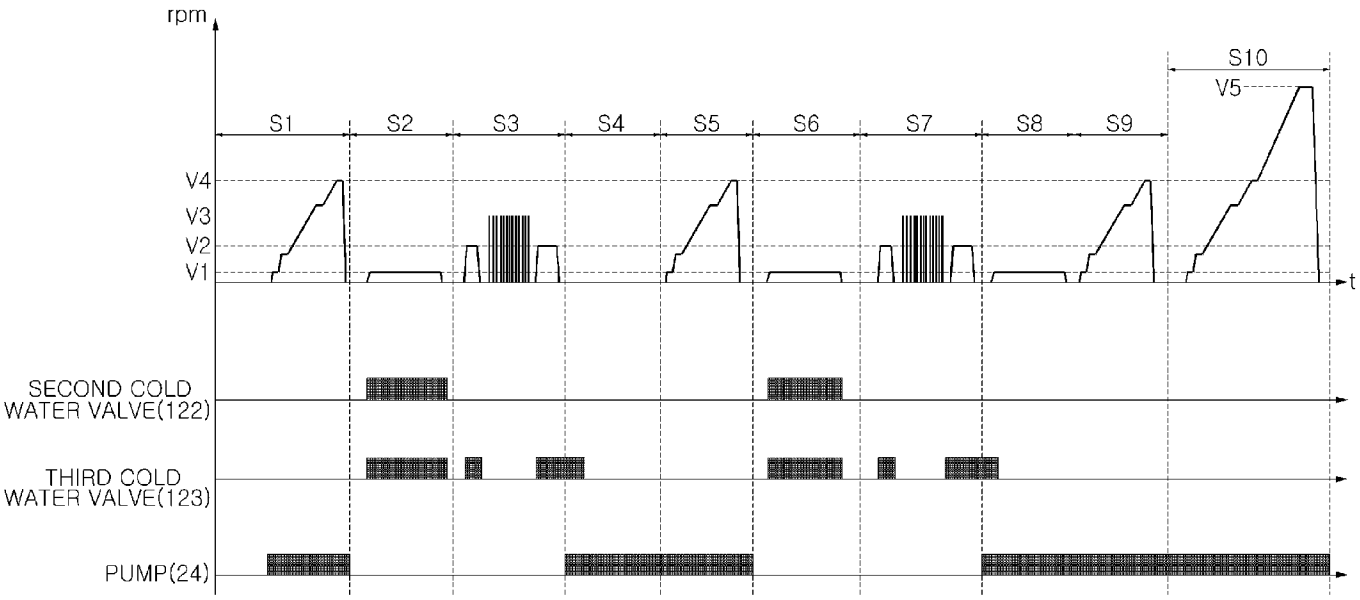
FIG. 9 is a graph showing the operation control of the main parts according to a control method of a washing machine of another embodiment of the present invention.

FIG. 9 is a graph showing the operation control of the main parts according to a control method of a washing machine of another embodiment of the present invention. Referring to FIG. 9, in the control method of a washing machine of another embodiment of the present invention is different from the above mentioned embodiments in that water is further supplied through the spray nozzle 50 in steps S2 and S6, and the other configurations are the same.

That is, in step S2 (or step S6), water is also supplied through the spray nozzle 50 together with the dispenser 30. Particularly, even if the same flow rate is supplied, the supply of water through the dispenser 30 can not wet all the laundry as long as water is not supplied to a level at which the laundry can be completely immersed in water. However, in the case where water is simultaneously supplied by the spray nozzle 50, water can be directly applied to the laundry, thereby wetting the cloth more quickly.

When the supply of water through the dispenser 30 and the supply of water through the spray nozzle 50 are simultaneously performed, the spray pressure of the spray nozzle 50 may not be sufficient. Therefore, in some embodiments, the supply of water through the dispenser 30 and the supply of water through the spray nozzle 50 may be performed with a time difference.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

The invention claimed is:

1. A method of controlling a washing machine comprising an outer tub containing water; an inner tub which accommodates laundry and is rotatably installed in the outer tub; a pulsator rotatably provided in a lower portion of the inner tub; a dispenser which supplies rinsing agent into the inner tub; a spray nozzle for spraying water into the inner tub; and a pump for draining the water contained in the outer tub, the method comprising the steps of:

(a) washing the laundry by using the water supplied together with detergent;

(b) draining the water used in the step (a), rotating the inner tub at a speed to perform the dewatering, and operating the pump to drain the water discharged from the laundry;

(c) rotating the inner tub at a first speed and supplying the water into the inner tub via the dispenser;

(d) stopping the supply of water through the dispenser, rotating the inner tub at a second speed, and supplying the water into the inner tub through the spray nozzle;

(e) stopping the supply of water through the spray nozzle and alternately rotating the pulsator at a third speed in both directions;

(f) stopping rotation of the pulsator, rotating the inner tub at the second speed, and supplying the water into the inner tub through the spray nozzle;

(g) operating the pump to drain the outer tub; and (h) rotating the inner tub at the speed to perform the dewatering, and operating the pump to drain the water discharged from the laundry, wherein the supply of water through the spray nozzle in the step (f) continues after the rotation of the inner tub is stopped until the step (g) is performed and the supply of water through the spray nozzle is stopped after an initial period of draining operation of the pump in the step (g), and wherein, during the initial period of the step (g), the supply of water through the spray nozzle is performed while the pump operates to drain the outer tub.

2. The method of claim 1, wherein, in the step (c), water is supplied until water level in the outer tub becomes equal to or higher than a preset centrifugal circulation water level, wherein washing water between the outer tub and the inner tub rises higher than an upper end of the inner tub, when the inner tub is rotated at the second speed in the centrifugal circulation water level.

3. The method of claim 2, wherein the second speed is 120 to 150 rpm.

4. The method of claim 2, further comprising:

a cloth amount detecting step of detecting an amount of the laundry, wherein the second speed is set according to the amount of the laundry detected in the cloth amount detecting step.

5. The method of claim 1, wherein the step (d) and the step (e) are repeated a preset number of times, before the step (f) is performed.

6. The method of claim 1, wherein, in the step (f), the water is supplied through the spray nozzle for a longer time than the step (d).

7. The method of claim 1, further comprising:

a cloth amount detecting step of detecting an amount of the laundry, wherein the third speed is set according to the amount of the laundry detected in the cloth amount detecting step.

8. The method of claim 1, wherein the third speed is 70 to 90 rpm.

9. The method of claim 1, further comprising:

a cloth amount detecting step of detecting an amount of the laundry, wherein the first speed is set according to the amount of the laundry detected in the cloth amount detecting step.

10. The method of claim 1, wherein the step (c) comprises supplying water through the spray nozzle.

11. A method of controlling a washing machine comprising an outer tub containing water; an inner tub which accommodates laundry and is rotatably installed in the outer tub; a pulsator rotatably provided in a lower portion of the inner tub; a dispenser which supplies rinsing agent into the inner tub; a spray nozzle for spraying water into the inner tub; and a pump for draining the water contained in the outer tub, the method comprising a step of washing the laundry by using the water supplied together with detergent, and performing rinsing to remove the detergent adhered on the laundry after the water used for the washing is drained, wherein the step of performing rinsing comprises the step of:

(a) rotating the inner tub at a first speed and supplying the water into the inner tub via the dispenser;

(b) stopping the water supply through the dispenser, rotating the inner tub at a second speed, and supplying the water into the inner tub through the spray nozzle;

(c) stopping the water supply through the spray nozzle, and alternately rotating the pulsator at a third speed in both directions;

(d) stopping the rotation of the pulsator, rotating the inner tub at the second speed, and supplying the water into the inner tub through the spray nozzle;

(e) operating the pump to drain the inner tub; and (f) rotating the inner tub at a speed to perform the dewatering, and operating the pump to drain the water discharged from the laundry, wherein the supply of water through the spray nozzle in the step (d) continues after the rotation of the inner tub is stopped until the step (e) is performed and the supply of water through the spray nozzle is stopped after an initial period of draining operation of the pump in the step (e), and wherein, during the initial period of the step (e), the supply of water through the spray nozzle is performed while the pump operates to drain the outer tub.

* * * * *